US006820519B2

(12) United States Patent
Lefebvre

(10) Patent No.: US 6,820,519 B2
(45) Date of Patent: Nov. 23, 2004

(54) CORK EXTRACTOR

(76) Inventor: Jacques Lucien Lefebvre, Chateau de la Begude, 13790 Rousset (FR)

( * ) Notice: Subject to any disclaimer, the term of this patent is extended or adjusted under 35 U.S.C. 154(b) by 5 days.

(21) Appl. No.: 10/369,732

(22) Filed: Feb. 21, 2003

(65) Prior Publication Data

US 2003/0126954 A1 Jul. 10, 2003

Related U.S. Application Data

(63) Continuation-in-part of application No. 09/601,153, filed as application No. PCT/FR98/02708 on Dec. 11, 1998, now abandoned.

(30) Foreign Application Priority Data

Jan. 28, 1998 (FR) ..... 98 01183

(51) Int. Cl.[7] ..... B67B 7/04
(52) U.S. Cl. ..... 81/3.47; 81/3.45
(58) Field of Search ..... 81/3.45, 3.47, 81/3.36, 3.29, 3.39, 3.55, 3.56, 3.09, 3.48; 7/155, 156

(56) References Cited

U.S. PATENT DOCUMENTS 899,407 A * 9/1908 Kampfe ..... 81/3.09
984,661 A * 2/1911 Halk ..... 81/3.37
4,437,359 A * 3/1984 Dejoux et al. ..... 81/3.09

FOREIGN PATENT DOCUMENTS

CH 515181 * 12/1971

* cited by examiner

*Primary Examiner*—Debra S. Meislin
(74) *Attorney, Agent, or Firm*—Dennison, Schultz, Dougherty & MacDonald

(57) ABSTRACT

A cork extractor includes a fulcrum element having two parallel side walls forming a channel therebetween with an open side and a closed side, the fulcrum element extending longitudinally at one end thereof to form a rim constructed and arranged to rest against a bottle neck. Each of the walls has a longitudinal slot formed therein between a first slot wall closer to the open side and substantially parallel to the side walls, and a second slot wall closer to the closed side, with a plurality of no more than three notches formed in the second slot wall distributed over the slot from a top end of the slot to a bottom end. These slots include a first notch at the slot end closer to the rim which includes a rounded bottom, and a second slot wall portion extended toward a mid-to upper-point of the first slot wall and a second notch having a rounded bottom. A lever having a pin at one end is freely slidable within the slot and which may be received in the notches to engage a selected one of the notches. A corkscrew wire is pivotally attached to the lever.

5 Claims, 3 Drawing Sheets

CORK EXTRACTOR

This application is a continuation-in-part of U.S. application Ser. No. 09/601,153 filed Jul. 27, 2000 now abandoned and incorporated herein by reference, which is a filing under 35 USC 371 of PCT/FR98/02708 filed Dec. 11, 1998.

BACKGROUND OF THE INVENTION

The invention relates to a variant of the lever-type corkscrew, also known as a wine-waiter's corkscrew.

In the conventional wine-waiter's corkscrew 10 shown in FIG. 1, there is a lever element 12 having a pivotally attached fulcrum element 14 at one end thereof, and a pivotally attached corkscrew wire 16 in the center of the lever element spaced from the fulcrum element. A knife 20 or other instrument may conveniently be attached to the opposite end of the lever.

In operation, the corkscrew wire 16 is inserted into the cork, and a hook-shaped lip 18 of fulcrum element 14 is secured onto the lip of a bottle. The user then lifts lever 12 while twisting the bottle to remove the cork.

These lever corkscrews thus base their operation on the movement of a lever in which the fulcrum situated at one of its ends co-operates with the end of the neck of a bottle, in which the resistance to be overcome is situated in the central zone and is constituted by the cork to be extracted, and in which the force applied to the other end of the lever is exerted by the hand of the user.

Although in very widespread use, such corkscrews nevertheless suffer from the drawback of not being capable of extracting the cork in a single operation because of the length of the cork and because of the limited stroke of the corkscrew lever, which often makes it necessary to restart the operation by screwing the corkscrew wire more deeply into the cork and repeating the extraction movement. The result is wasted motion, as well as splitting or breaking the cork.

Moreover, the distance between the corkscrew wire and the fulcrum must be much greater than the radius of the bottle, to permit there to be sufficient space to insert one's hand between the lever and the opposite side of the bottle. This results in the cork being extracted at an angle, rather than vertically out of the bottle, which contributes to damage to the cork.

SUMMARY OF THE INVENTION

It is therefore the object of the present invention to remedy these drawbacks, in particular by reducing the traction force, as well as to place the corkscrew wire closer to the fulcrum and enable the cork to be lifted more vertically out of the bottle.

To achieve these and other objects, the invention is directed to a modification of the lever corkscrew and in particular to the fulcrum element which bears against the rim of the neck of a bottle, which modification is specially designed to enable a cork which closes a bottle to be extracted quickly, smoothly, and completely with a minimum of effort.

The invention further relates to a corkscrew having a fulcrum element fitted with a limited number of drop-shaped notches, thereby enabling longer corks to be extracted without the necessity of reinsertion of the corkscrew wire further into the cork, since the stroke of the corkscrew wire can be increased by using the second or the third fulcrum.

According to the invention, the lever type corkscrew fitted with the slotted and multiple-notched fulcrum element and a hinged corkscrew wire is remarkable in that it has notches situated at a plurality of levels on the fulcrum element, thereby enabling the pin of the actuating lever to be placed at different levels so as to make it possible to obtain a greater lifting margin for extracting the cork and also obtain movement of the corkscrew wire that is more vertical.

In prior art corkscrews, the fulcrum element which is placed on the rim of the neck of the bottle can be used only at the beginning of the rotary movement of the lever arm to which it is attached by a pin; according to the invention however, the fulcrum element can slide freely vertically, thereby changing the height at which it acts so as to enable longer corks to be extracted.

DESCRIPTION OF THE PREFERRED EMBODIMENTS

Figure 1:
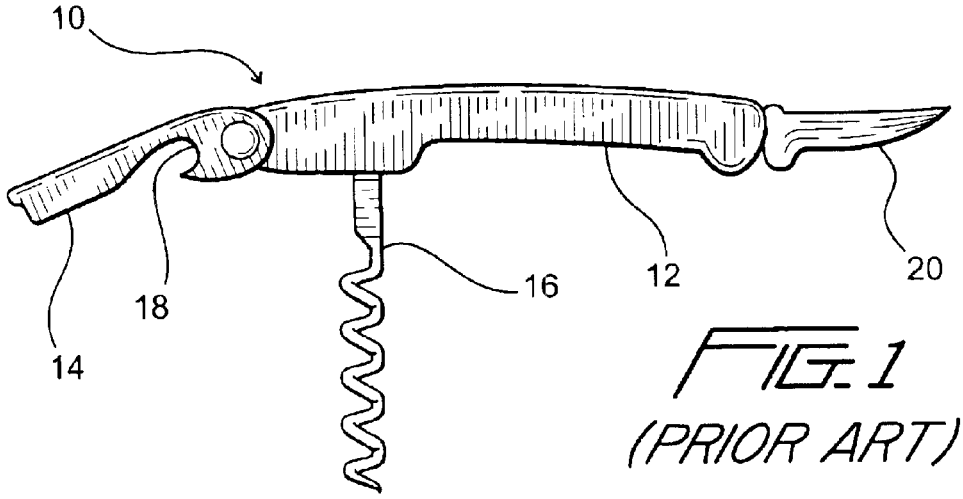
FIG. 1 (PRIOR ART)
FIG. 1 is a side view of a typical prior art corkscrew.
Figure 2A:
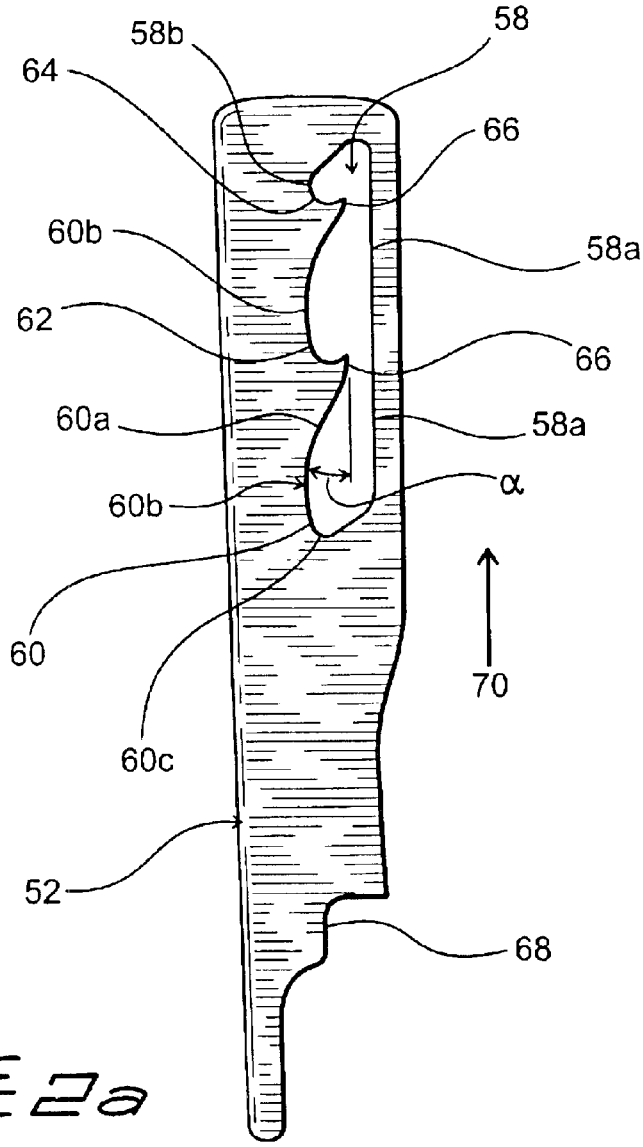
FIG. 2*a* is a detailed side view of the fulcrum element shown in FIG. 2.
Figure 2:
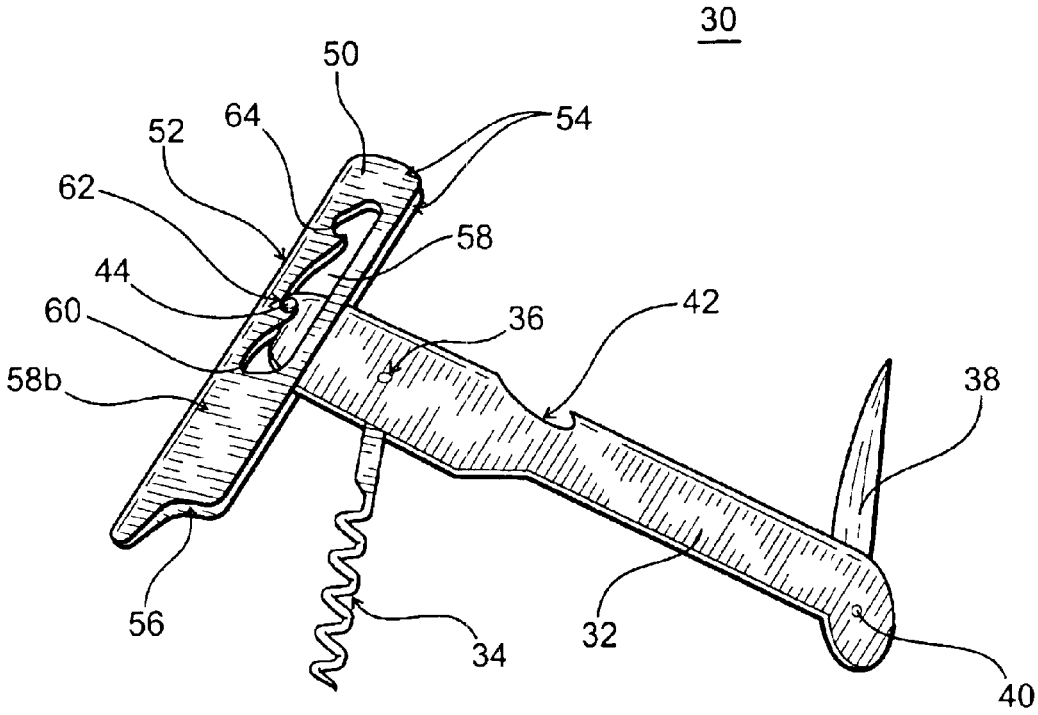
FIG. 2 is a side view of the cork screw of the invention with its various elements deployed.

FIG. 2 shows a cork extractor 30 according to the invention, including a lever 32 having a corkscrew wire 34 attached at pivot 36. The lever also advantageously includes a knife blade 38 attached to a pivot 40 at one end thereof, and a notch 42 in one edge which serves to remove crown caps. These devices are well known in the art.

Figure 4:
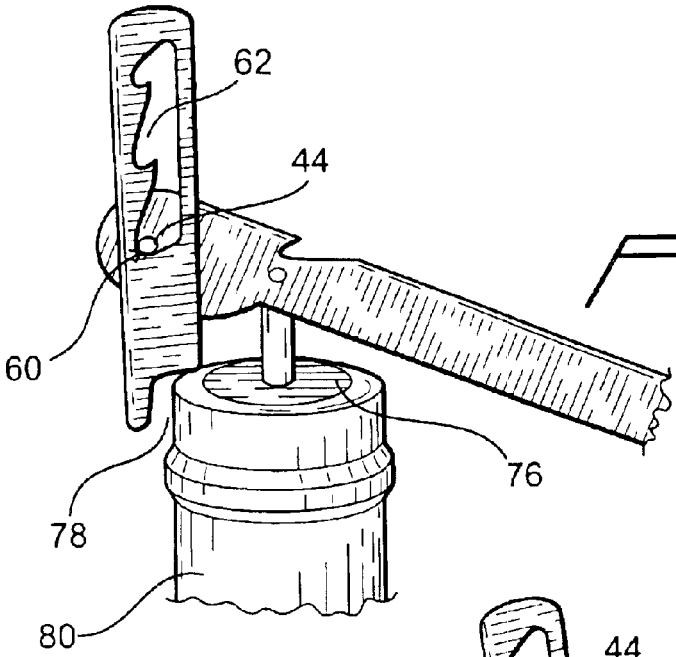
FIG. 4 is a partial side view of the corkscrew of the invention upon initial insertion into a cork.
Figure 5:
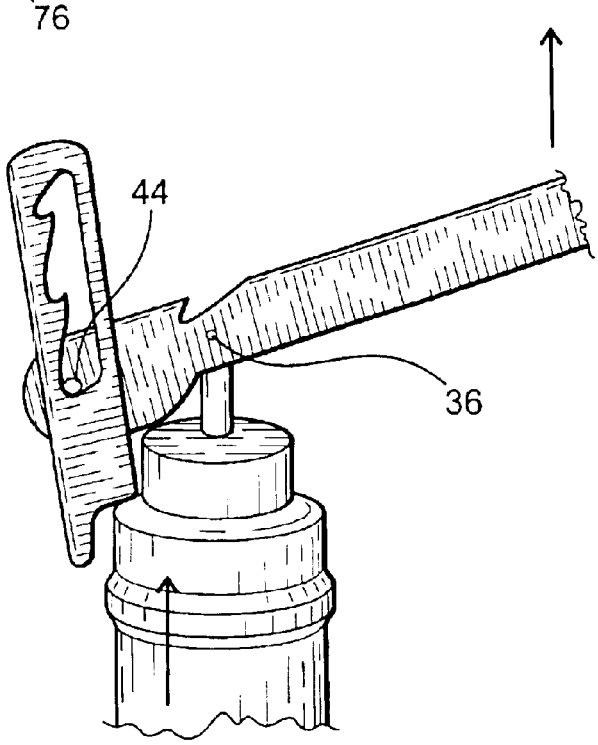
FIG. 5 is a partial side view of the corkscrew of the invention after an initial lifting action.
Figure 6:
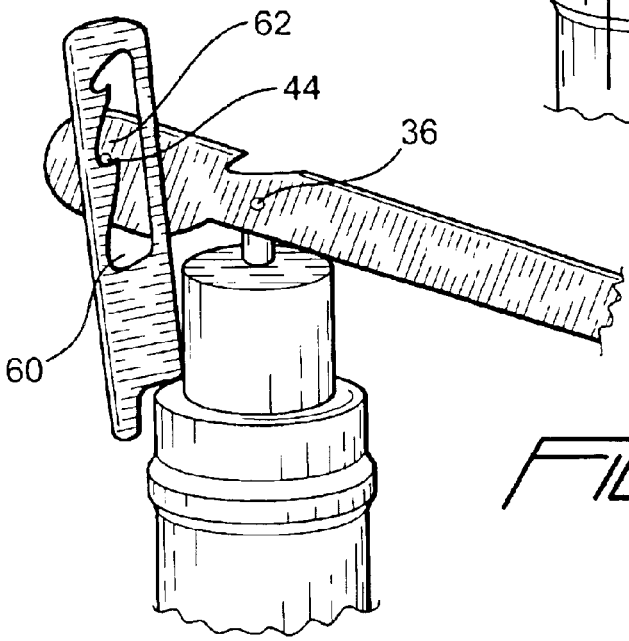
FIG. 6 is a partial side view of the corkscrew of the invention after a further lifting action.

A pin 44 passes through the lever at the end opposite to the end at which the knife blade 38 is attached. At this end of the lever there is disposed a fulcrum element 50 including a web 52 (or back) to which are attached two generally parallel side cheeks 54 leaving an open channel 56 opposite to the web. Each of the cheeks 54 has a longitudinal slot 58 including notches 60, 62 and 64. The lever 32 and fulcrum element 50 are so arranged that the lever is inserted into the channel 56 (FIG. 2) and the pin 44 slides in the slot 58. The pin 44 includes an enlarged stop element at each end thereof so that the pin 44 is retained in the slot (FIG. 3), and enables the fulcrum and lever to pivot about each other. The fulcrum element also has a step-shaped rim 68 at one end thereof enabling it to bear against the neck 78 of a bottle 80 as shown in FIGS. 4–6.

The fulcrum element 50 is shown in detail in FIG. 2*a*. Slot 58 is formed from a first wall 58*a* closer to the open channel 56 and a wall 58*b* closer to web 52. Notch 60 is closer to the bottom of the slot 58, with notch 62 above it, and notch 64 closer to the top end of the slot.

The dimensions of the slot and the notches are important to the proper operation of the cork extractor. In particular, slot 58 has a length which is substantially that of the longest cork which is to be extracted. Since most corks are in the range of 35–55 mm, the slot should be at least 35 mm in length, and up to about 55 mm.

To reduce wasted motion, the number of notches should be substantially limited to three. A device with three notches is preferred. A device with two notches, for example, will not be sufficient for extraction of long corks, and a third notch will be required for these corks. Where a device has three notches, there will be two long notches, such as notches 60 and 62, each making up about 40–45% of the length of the slot 58, and a short notch such as notch 64. Where the device has only two notches, there will usually be a long notch such as notch 60 and a short notch such as notch 64.

Notches 60 and 62 end at a point 66 which is connected to an angled wall portion 60*a* which is at a relatively small angle α with respect to the direction of travel of the pin, shown by arrow 70 in FIG. 2*a*. To enable easy operation, this angle should be no more than about 30°, and will usually be at least about 20°.

In general, the angled wall portion 60*a* is directed toward a mid- to upper-point on the opposite wall. A mid-point of the wall would be, for example, at 30 to 60% of the wall height, where, as shown in the drawings, there are three notches. Where there are only two notches, the angled wall portion might be directed to an upper-point of the opposite wall, for example, at 70 to 90% of the wall height.

Moreover, each of the notches 60 and 62 also has a wall portion 60*b* which is generally parallel to the wall 58*a*, enabling the pin to slide in the notch in a direction parallel to the channel.

The notch portion 60*c* is minimized in radius to reduce the travel of the pin in the direction perpendicular to the length of the slot.

The distance between the pin and the corkscrew wire is about twice the radius of a bottle, or about 19 mm for a bottle of 9.5 mm radius, so that the cork will travel directly in an upward direction out of the bottle, and not at an angle to the bottle.

Figure 3:
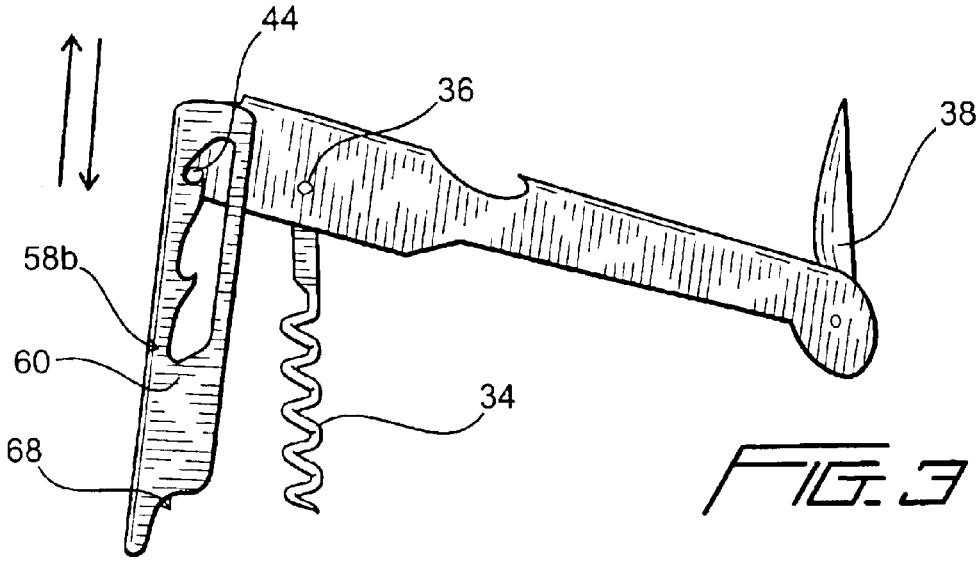
FIG. 3 is a side view of the corkscrew of the invention ready for insertion into a cork.

FIG. 3 has arrows to show how the fulcrum element enables the pin 44 situated at the end of the lever to be slid to occupy different working positions by being engaged in the notches situated along the two slots of the fulcrum element.

FIG. 4 shows the cork extractor before beginning an extraction operation with the corkscrew wire 34 fully screwed into cork 76. The pin 44 of the lever 32 is then positioned in the first notch 60 and the rim 68 rests on the lip 78 of bottle 80.

By lifting the lever 32, the pin 44 pivots in the first notch 60, removing about half of the cork from the bottle, as shown in FIG. 5.

By pulling down on the lever 32, the pin is then slid along notch 60 into notch 62, without pushing the cork back into the bottle. Because of the shape of the slot, this is a smooth, almost automatic action; a difficult manipulation of the lever to move the pin from notch to notch is not necessary.

With the pin in the second notch 62, one again pulls up on lever 32, and the pin pivots in notch 62, further removing the cork, as shown in FIG. 6. This action often will fully remove the cork; if it does not fully remove the cork, the lever 32 may again be pushed downward to slide the pin into notch 64. At that point, pulling up on the lever will fully remove the cork.

In this way, the corkscrew is ready to act as shown in FIGS. 4–6, by exerting an upwardly directed force by means of the lever which entrains the corkscrew wire and simultaneously causes the cork to start moving out from the neck. This disposition enables the cork to be extracted in a plurality of steps, depending on how deeply it is engaged and on how much of the cork has been extracted from the bottle, and this can be done without any need to twist the bottle or screw the corkscrew wire further into the cork.

It is thus possible to obtain maximum continuous displacement, which cannot be done with a lever corkscrew of the ordinary type.

By locating the pivot of the corkscrew wire close to the pin, the movement of the corkscrew wire is almost vertically upwards, such that the cork is subjected to little or no off-axis traction force, thereby eliminating the risk of the cork being bent or broken. This modification makes it possible to use the corkscrew quickly and effectively with the extraction operation taking place with the pin occupying two or three positions in succession where it is received in the notches of the fulcrum element merely by being pushed into them.

The new type of fulcrum element is applicable to commercially-available lever type corkscrews that are essentially flat in shape and small in size, as required for lever type corkscrews that are carried in a pocket in a convenient manner by the most frequent users who are waiters in cafes, wine waiters and bartenders.

What is claimed is:

1. A cork extractor comprising:

a fulcrum element comprising two parallel side walls forming a channel therebetween with an open side and a closed side, the fulcrum element extending longitudinally at one end thereof to form a rim constructed and arranged to rest against a bottle neck, each of said walls having a longitudinal slot formed therein between a first slot wall closer to the open side and substantially parallel to the side walls, and a second slot wall closer to the closed side, with a plurality of no more than three notches formed in the second slot wall distributed over the slot from a top end of the slot to a bottom end, said slots comprising:

a first notch at the slot end closer to the rim which comprises a rounded bottom, and a second slot wall portion extended toward a mid- to upper-point of the first slot wall and a second notch comprising a rounded bottom;

a lever having a pin at one end thereof which is freely slidable within said slot and which may be received in said notches to engage a selected one of said notches; and a corkscrew wire pivotally attached to said lever and spaced from said pin;

whereby a cork can be extracted from a bottle neck by inserting the corkscrew wire in the cork with the pin in a first notch, pulling up on the lever to at least partially extract the cork, moving the pin to a subsequent notch and pulling up on the lever again to further extract the cork.

2. The cork extractor of claim 1, wherein three notches are formed in the second slot wall.

3. The cork extractor of claim 2, wherein the third notch is disposed between the first and second notches, the third notch substantially corresponding in shape to the first notch.

4. The cork extractor of claim 1, wherein the fulcrum element comprises a strip of folded sheet metal.

5. The cork extractor of claim 3, wherein the first and third notches further comprise a slot wall portion substantially parallel to the first slot wall, and which connects the rounded bottom to the second slot wall portion.

* * * * *